United States Patent [19]

Long et al.

[11] Patent Number: 4,464,795

[45] Date of Patent: Aug. 14, 1984

[54] EASY ACCESS UNDERWATER DIVING SUIT

[75] Inventors: Richard W. Long; Robert T. Stinton, both of San Diego, Calif.

[73] Assignee: Diving Unlimited International, Inc., San Diego, Calif.

[21] Appl. No.: 389,407

[22] Filed: Jun. 17, 1982

[51] Int. Cl.[3] ..... B63C 11/04

[52] U.S. Cl. ..... 2/2.1 R; 2/69; 2/79

[58] Field of Search ..... 2/2.1 R, 69, 69.5, 79, 2/80

[56] References Cited

U.S. PATENT DOCUMENTS

| | | | |
|---|---|---|---|
| 3,086,214 | 4/1963 | Lash . | |
| 3,493,972 | 2/1970 | Oldham | 2/2.1 R |
| 3,643,264 | 2/1972 | Rector | 2/2.1 R |

FOREIGN PATENT DOCUMENTS

| | | | |
|---|---|---|---|
| 0029771 | 6/1981 | European Pat. Off. . | |
| 214708 | 8/1908 | Fed. Rep. of Germany . | |
| 1099779 | 9/1955 | France . | |
| 2127140 | 9/1972 | France . | |
| 471550 | 6/1969 | Switzerland | 2/79 |
| 620450 | 3/1949 | United Kingdom . | |
| 1139712 | 1/1969 | United Kingdom . | |

*Primary Examiner*—Werner H. Schroeder
*Assistant Examiner*—Judith L. Kravitz
*Attorney, Agent, or Firm*—Brown & Martin

[57] ABSTRACT

An easy access underwater diving suit in which the torso portion of the suit is longer than a diver's torso height and that has a diagonal zippered opening in the upper front portion from shoulder to opposite hip to provide a maximum, easy access opening. After the diver is inside the suit, the torso portion of the suit is adjusted to the height of the diver. A fastening arrangement holds the suit in the adjusted condition.

14 Claims, 5 Drawing Figures

EASY ACCESS UNDERWATER DIVING SUIT

BACKGROUND OF THE INVENTION

The present invention relates to underwater diving suits. Conventional diving suits are cumbersome to put on and take off because they must fit rather snugly when on the diver. People who dive are of different heights and it is impossible to provide a suit of uniform size which will fit all divers even though the suit material is stretchable. A waterproof zipper is positioned on the suit closure which is partially or entirely located on the back of the suit. This makes it impractical for the diver inside the suit to operate the zipper and a second person is required to close the zipper. Also, the zipper in the back is very uncomfortable and restricting to the diver.

It is a primary object of the present invention to provide a new and improved underwater diving suit which can be quickly and easily put on and taken off by the diver without requiring assistance.

It is another object of the present invention to provide such a new and improved underwater diving suit that is simple and inexpensive to manufacture.

It is a further object of the present invention to provide such a new and improved underwater diving suit which is attractive in appearance, and which has no zipper restriction in the back.

SUMMARY

The objections to the conventional construction are overcome and the above objectives are attained by an exemplary embodiment of the invention wherein the suit torso portion is made longer than the torso height of a diver and includes means for reducing the length of the suit when the diver is inside. Large diagonal access means in the upper front portion of the body of the suit provides easy access, and fastening means holds the suit in the shortened position.

DETAILED DESCRIPTION OF THE INVENTION

The present invention provides an underwater diving suit with a torso length longer than required by the user. It has, in effect, a telescoping material section or panel in the body. A zippered opening runs diagonally from one shoulder of the diving suit to the opposite hip to provide a large access opening. The telescoping section of the suit adds the amount of torso length needed to don and remove the neck seal or neck and hood seal combination. Once the diver is inside the suit and the opening is sealed by the zipper, the telescoping midsection is folded back to reduce the length of the suit to the operative position and is held in place by a fastening element such as a crotch strap or shoulder strap.

Figure 1:
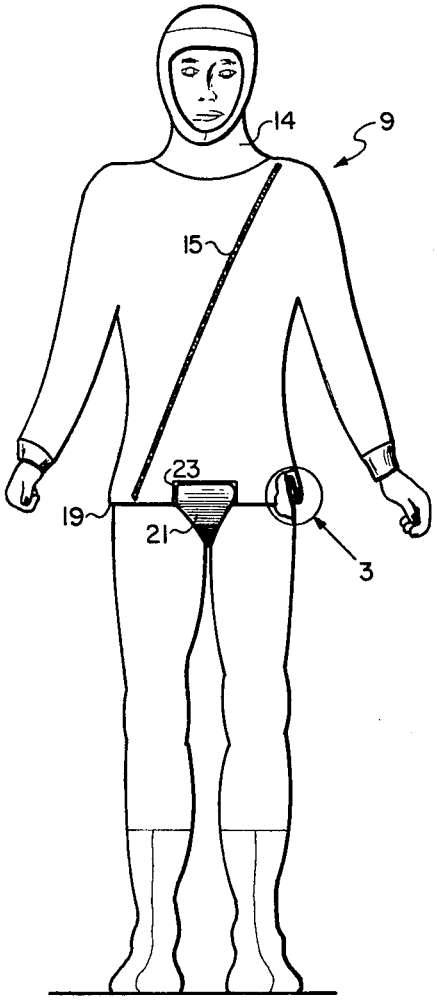
FIG. 1 is a front elevation of an underwater diver wearing a diving suit constructed in accordance with the present invention using fastening means in the form of a crotch strap.
Figure 2:
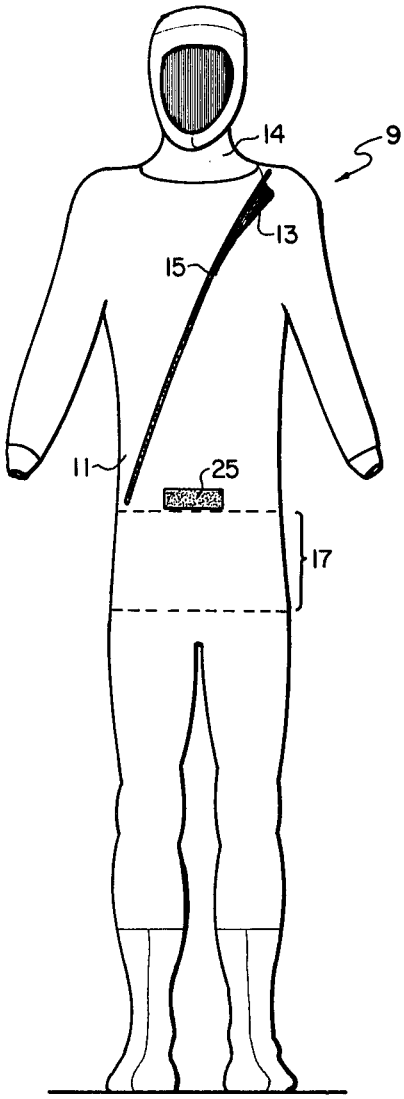
FIG. 2 is a front elevation of the diving suit shown in FIG. 1 in the elongated position before it is donned by the diver.
Figure 3:
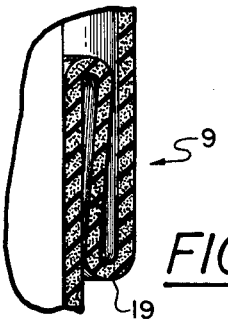
FIG. 3 is an enlarged fragmentary view taken within the circle indicated at 3 in FIG. 1.

The first embodiment of the present invention is shown in FIGS. 1–3 of the drawings. An underwater diving suit 9 includes an elongated body portion 17 as shown in FIG. 2. The suit in this extended condition is longer than the height of the diver. The suit 9 is made of a flexible, stretchable waterproof material such as sponge rubber. A long opening 13 runs diagonally across the torso of the suit from the shoulder to the opposite hip portion of the suit. This opening has a zipper 15 mounted therein for opening and closing the opening. The increased length of the diving suit 9 and the elongated diagonal opening 13 render the suit easy to don and remove. This positioning and configuration of the opening provide maximum access to the interior of the suit for the torso height. The additional torso length of the suit makes it possible to quickly and easily don and remove the neck seal or hood seal 14.

Once the diver is inside the suit, the midsection 17 is folded back on itself with the upper portion of the suit being folded over the lower portion so that the fold line 19 has the appearance of a jacket worn over a pair of diving pants. A beaver tail strap 21 is connected permanently, or removably by a velcro strip, to the back of the suit and hangs down so that it can be grasped between the legs and brought up under the crotch of the diver's suit. The free end of the strap 21 includes a velcro (trademark) fastening surface 23 that is engaged with a mating velcro fastening pad 25 on the front of the diving suit. Thus, while the suit provides easy access, it is also adjustable to a comfortable wearing condition with an attractive appearance. The first embodiment of our underwater diving suit illustrated in FIGS. 1–3 is dimensioned so that it fits tightly against the diver's skin and follows the contour of the diver's body to optimize the suit's thermal insulation properties and reduce its bulkiness. The mid section 17 of the suit can be of the same material as the remainder of the suit or it can be made of a more flexible or stretchable material for easy adjustment.

Figure 4:
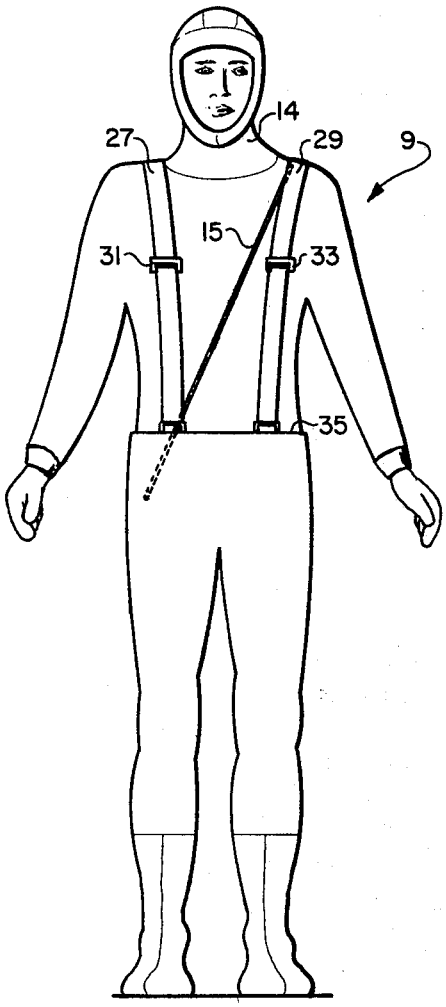
FIG. 4 is a front elevation of an underwater diver wearing a diving suit with fastening means in the form of shoulder straps.
Figure 5:
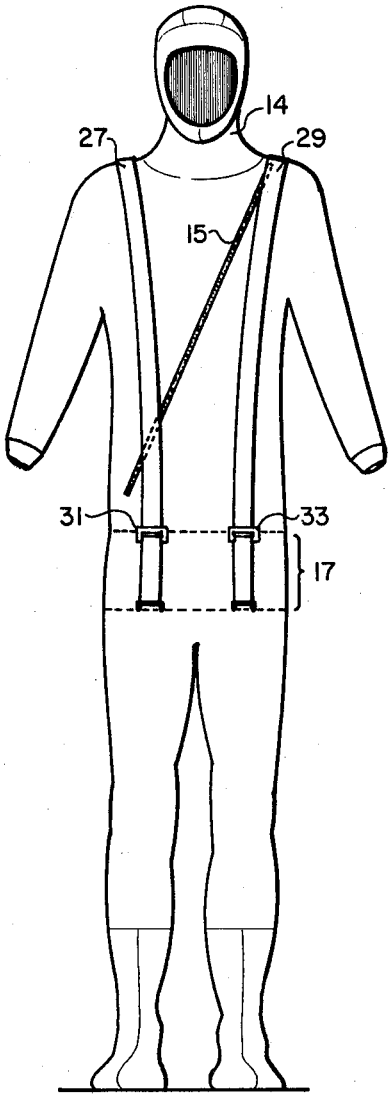
FIG. 5 is a front elevation of the diving suit shown in FIG. 4 in the elongated position.

The second embodiment of the present invention is shown in FIGS. 4 and 5 of the drawings. In this embodiment, the beaver tail strap 21 and fastening pad 25 are replaced by a pair of suspender type straps 27 and 29. The strap 27 has an adjusting buckle 31 thereon and strap 29 has an adjusting buckle 33 thereon. The straps are affixed to and extend from a point near the crotch of the suit in the front of the suit to a similar point in the back of the suit. The buckles 31 and 33 are positioned on the lower ends of the straps 27 and 29 in the front for easy handling by the diver. Once the diver is inside the suit, he pulls the straps 27 and 29 up to shorten the suit and adjusts the buckles 31 and 33 to hold the suit in the shortened position. In this arrangement, it appears that the diver has a pair of diving pants pulled over a diving shirt at the fold line 35.

It has been found that an arrangement wherein the fold is approximately one-half the length of the midsection provides a good construction. The panel is about eight to twelve inches in length and the fold is about four to six inches in length. This results in a comfortable arrangement without excessive bulk.

The diving suit of the present invention is easy to don and remove while maintaining an attractive appearance.

Having thus described our invention, we claim:

1. An easy access suit, comprising:

a suit body of a length that is longer than a person's height;

access means extending diagonally across the upper front portion of said suit body for providing maximum access to the interior of the suit;

means integral with the suit body for shortening the length of said suit body to adjust the suit body to the person's height once the person is inside the suit body including a midsection of said suit body which is foldable upon itself; and means for holding said suit body in the shortened position including shoulder strap means extending from the front midsection of said suit body to the rear midsection of said suit body and affixed to said midsection, said shoulder strap means having adjusting means thereon;

whereby the length of said suit body is adjustable by adjusting said shoulder strap means with said adjusting means.

2. An easy access suit according to claim 1 wherein said midsection is a panel made of a flexible, waterproof material.

3. An easy access suit according to claim 1 wherein said midsection is a panel made of a stretchable, waterproof material.

4. An easy access suit according to claim 1 wherein said adjusting means is on the lower portion of said shoulder strap means within easy reach of the person when the suit body is on the person.

5. An easy access suit according to claim 1 wherein the midsection is about eight to twelve inches in length and is folded back upon itself to provide a fold from about four to six inches in length.

6. A suit, comprising:

a suit body made of a flexible waterproof material, said suit body including a midsection which is foldable upon itself around its entire circumference to thereby shorten the length of said suit body to accommodate a person's size;

access means extending diagonally across an upper front portion of said suit body above said foldable midsection for providing maximum access to the interior of the suit body; and means for holding the suit body in its shortened configuration.

7. A suit according to claim 6 wherein the suit body is made of sponge rubber.

8. A suit according to claim 6 wherein the holding means includes elongate strap means connected at one end to said suit body on one side of a crotch of said suit body for passing through the crotch and means for connecting the other end of said strap means to said suit body on the other side of said crotch.

9. A suit according to claim 6 wherein the holding means includes a beaver tail strap.

10. A suit according to claim 6 wherein the suit body has a length which is greater then the person's height.

11. A suit according to claim 6 wherein the holding means includes adjustable shoulder strap means extending from the front midsection of said suit body to the rear midsection of said suit body.

12. A suit according to claim 6 wherein the suit body is made of sponge rubber and is dimensioned to fit tightly against the person's body.

13. An easy access underwater diving suit comprising:

a sponge rubber suit body including integrally connected jacket and pants portions, said suit body having an access opening for permitting a diver to don said suit body;

said suit body midsection being rollable over itself to provide three overlying layers thereof around the entire circumference of said midsection to thereby shorten said suit body to accommmodate the size of the diver;

said access opening extending across the jacket portion of said suit body above said foldable midsection;

a zipper for closing said access opening;

means for releasably holding the suit body in its shortened configuration after it has been donned by the diver; and said suit body being dimensioned to fit the contours of the diver's body after said suit body has been donned by the diver and shortened.

14. An easy access underwater diving suit comprising:

a unitary sponge rubber suit body having a telescoping midsection dimensioned to add sufficient torso length to permit a diver to readily don said suit body, said midsection being foldable upon itself around its entire circumference to thereby shorten the length of said suit body to accommodate the diver's size;

an access opening extending diagonally across a front torso portion of said suit body above said foldable midsection from a shoulder portion of said suit body to a hip portion of said suit body;

a zipper for sealing said diagonal opening;

a beaver tail strap connected at one end to the back of said suit body and passable through a crotch of said suit body; and means for removably connecting the other end of said beaver tail strap to the front of said suit body to hold said suit body in its shortened configuration.

* * * * *